United States Patent [19]

Zwayer et al.

[11] 4,241,913

[45] Dec. 30, 1980

[54] RAPID THRUST EXERCISE MACHINE

[75] Inventors: Don L. Zwayer; Martin D. Sadler, both of Tulsa, Okla.

[73] Assignee: Natural Energy of Oklahoma, Inc., Tulsa, Okla.

[21] Appl. No.: 939,393

[22] Filed: Sep. 5, 1978

[51] Int. Cl.[3] ..... A63B 21/00

[52] U.S. Cl. ..... 272/130; 272/134

[58] Field of Search ..... 272/130, 143, 134, 72, 272/67, 144, DIG. 1, DIG. 4; 128/25 R

[56] References Cited

U.S. PATENT DOCUMENTS

| | | | |
|---|---|---|---|
| D. 226,439 | 3/1973 | Coker | 272/134 X |
| 3,369,403 | 2/1968 | Carlin et al. | 272/130 X |
| 3,465,592 | 9/1969 | Perrine | 272/125 X |
| 3,638,941 | 2/1972 | Kulkens | 272/DIG. 4 X |
| 3,822,599 | 7/1974 | Brentham | 272/130 X |
| 3,850,431 | 11/1974 | Winans | 272/134 X |

*Primary Examiner*—Richard C. Pinkham
*Assistant Examiner*—William R. Browne
*Attorney, Agent, or Firm*—James H. Chafin

[57] ABSTRACT

An exercise machine utilizing a pivotal bar wherein resistance to applied force in one direction is provided by the passing of hydraulic fluid through an adjustable orifice and including a fluid bypass around said orifice to eliminate resistance to the force applied in the opposite direction.

7 Claims, 2 Drawing Figures

RAPID THRUST EXERCISE MACHINE

BACKGROUND OF THE INVENTION

1. Field of the Invention

The present invention relates to an exercise machine and more particularly, but not by way of limitation, to an exercise machine which utilizes the flow of hydraulic fluid through a restriction to provide opposing force to the operator's applied force.

2. History of the Prior Art

For several years coaches of various athletic sports have realized that body building and muscle exercise is extremely important in developing a athlete so that he can perform in the sport for which he is training. Historically, weight lifting was one of the basic forms of body building exercise used for training athletes. However, in recent years there has been a strong trend toward the use of isometric exercises in place of weight lifting. Positive results have been reported from both types of exercise, but both have definite drawbacks.

While weight lifting provides a relatively smooth work out of the muscles being exercised, the weights have to be often changed to fit the physical needs and size of the user which is very time consuming. Further, a complete weight lifting program requires a substantial outlay of capital, especially when providing weight lifting equipment for use by a physical education class or by a team of athletes.

Further, and more importantly, the weight lifting program has always been accompanied by the danger involved in dropping individual weights during the exercise and the problem of straining a muscle when lifting the weights into position or ending the exercise. In fact, most injuries to weight lifters occur while the weights are being positioned for the desired exercise or setting the weights down after the exercise.

Isometric exercises, on the other hand, do not normally require extensive equipment and are not accompanied by the dangers inherent in weight lifting. However, in performing isometric exercises one applies pressure to an immovable object to exercise particular muscles in one position only which does not allow the muscle to travel through its full range of movement. It has been noted that the typical student of isometric exercises soon loses interest in the exercise since he cannot readily see how much force is being applied and normally he becomes bored with the exercise since there is virtually no movement and hence no sense of accomplishment. Another drawback of the isometric exercise is there is a negligible buildup on the cardiovascular system due to this lack of movement.

Various machines have been developed to provide a moving exercise relying on the passing of hydraulic fluid through various systems in order to regulate the force needed in performing the exercise. A typical machine of this nature is disclosed in the patent to Brentham, U.S. Pat. No. 3,822,599, issued July 9, 1974, for a "EXERCISE DEVICE," wherein a pair of hydraulic cylinders are attached to a movable framework such that the movement of the frame in any direction will require fluid to pass through restriction orifices in order to resist movement of the frame.

Other exercise machines have been developed in order to similate the weight lifting exercise or the isometric exercise and which use, to resist the applied force, various pneumatic flow valves, springs and the like.

SUMMARY OF THE PRESENT INVENTION

The present invention provides an exercise machine which has been particularly designed and developed to utilize the desired features of the isometric and weight lifting type of exercises while attempting to virtually eliminate the various drawbacks and dangers associated with such exercises.

It has been recently discovered that certain specialized exercises are adept at increasing the ability of an athlete in a particular sport such as a rigid squat and extension exercise for basketball players resulting in their ability to jump greater heights. However, such exercise, to be most effective, requires that the force in resisting the straightening of the legs be a strong force and that the exerciser be able to encounter this force in rapid succession by bending and straightening the legs. This requires that there be absolutely no force resisting the exerciser when he is going into the squat position but that force be immediately applied to resist the straightening of his legs.

Naturally, to perform the type of exercise hereinbefore set forth, weight lifting is undesirable since the weights constantly exert a downward pressure resisting both the movement of straightening the legs and going into a squat position. On the other hand, isometric exercises are not very effective since the muscle under strain is not allowed to travel through its full range of movement and hence is in essence exercised in only one position.

The use of the Brentham patented device as hereinbefore set forth is ineffective since Brentham clearly teaches that his device strongly resists force in one direction and moves very slowly in the opposite direction, hence preventing rapid repetition of the exercise.

The present invention in the embodiment shown, however, provides an elongated exercise bar which is pivotally attached to a frame member and is equipped with a suitable operator interface pad and handles at one end of the frame in order to actuate the exercise device or to apply force to pivot the exercise bar.

The exercise device further employs a single hydraulic cylinder which is pivotally attached between the frame and the exercise bar. The cylinder is equipped with cooperating piston and piston rod reciprocally disposed within the cylinder, the rod being pivotally attached to the frame and spaced from the fulcrum point of the exercise bar itself. The frame device is provided with a hollow cavity for receiving hydraulic fluid therein to form a reservoir of hydraulic fluid. The lower end of this reservoir is attached by a communication line to the lower end of the hydraulic cylinder through a valve apparatus.

The valve apparatus comprises an adjustable restriction orifice so that fluid passing from the lower end of the hydraulic cylinder through the valve apparatus must pass through the restriction orifice which provides back pressure and hence force against movement of the piston in one direction. When the piston is moved in the opposite direction it will tend to such the fluid back into the piston chamber and in this case the valve apparatus is provided with a bypass line through the valve having a check valve installed therein so that fluid freely passes back ito the hydraulic cylinder. Again, when the piston within the cylinder is moved in the opposite direction, the check valve closes thereby requiring the fluid to pass through the restriction orifice.

Also attached to the line in communication with the fluid side of the hydraulic cylinder is a pressure gauge which is calibrated with respect to the operator interface so that the number of pounds of force applied at the operator interface is displayed on a pressure gauge so that the user could see how many pounds or units of force are actually being applied.

The present invention therefore provides an exercise device whereby the user is able to apply as much force as he is able to apply rapidly to the system and see the results of his efforts displayed on the pressure gauge. It is noted at this point that the machine disclosed herein may be modified or adapted to allow the user to perform substantially any exercise without departing from the scope of invention.

DESCRIPTION OF THE DRAWINGS

Other and further advantageous features of the present invention will hereinafter more fully appear in connection with a detailed description of the drawings, in which.

DESCRIPTION OF THE PREFERRED EMBODIMENT

Figure 1:
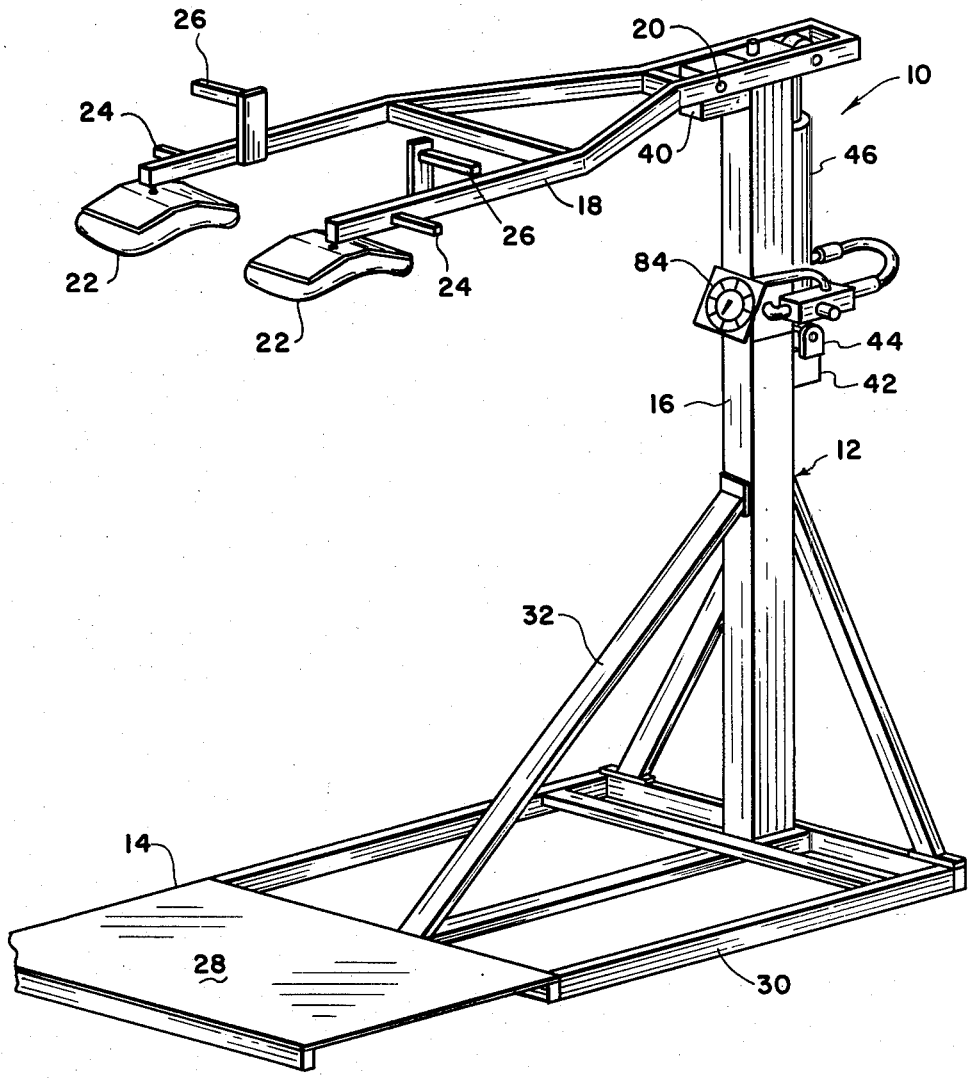
FIG. 1 is a perspective view of an exercise machine embodying the present invention.
Figure 2:
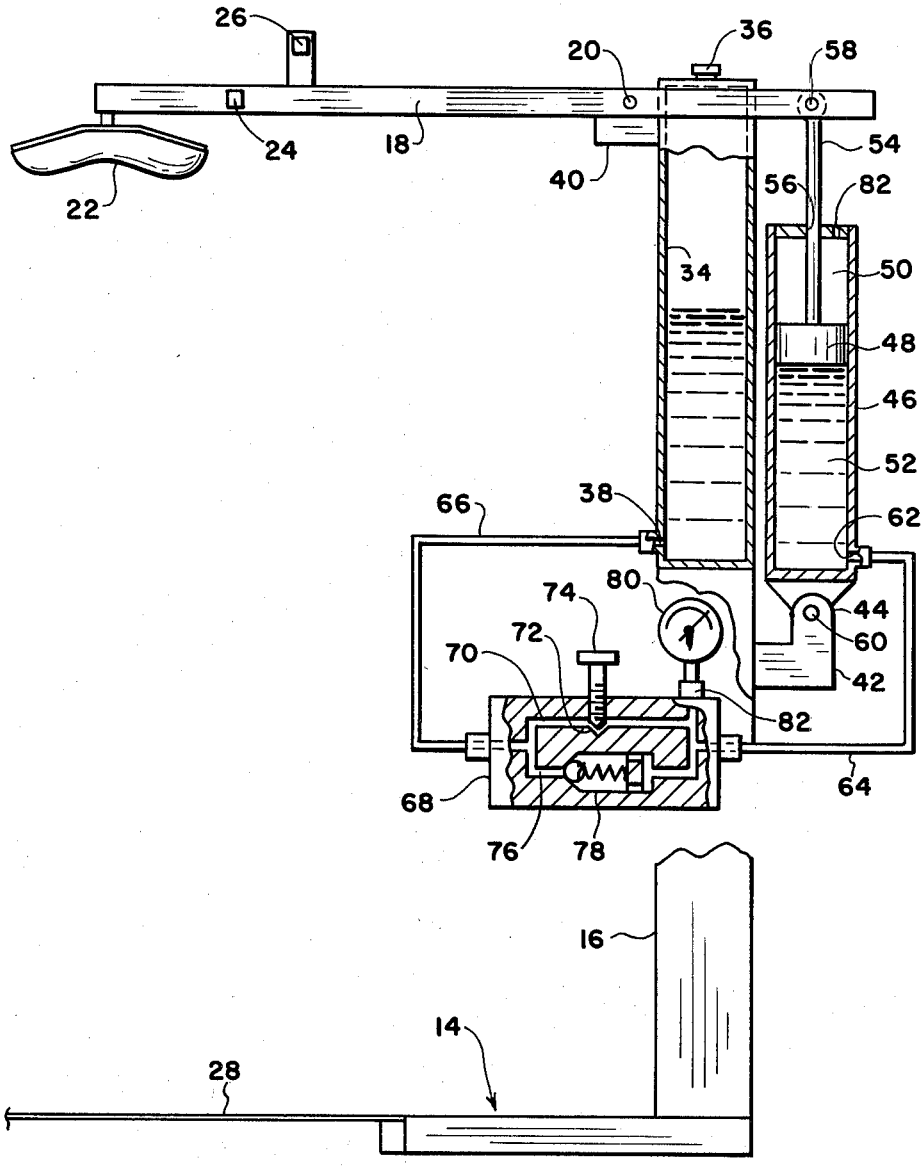
FIG. 2 is a side elevational view partially in section of the machine of FIG. 1.

Referring to the drawings in detail, reference character 10 generally indicates an exercise machine having a frame apparatus 12 which generally comprises a platform portion 14 and an elongated upright portion 16. An exercise bar is pivotally attached to the upper end of the frame by way of a horizontally extending fulcrum or pivot pin 20. One end of the elongated exercise bar 18 extends over the platform portion 14 of the frame and is equipped with suitable operator interface or actuator devices such as a pair of spaced shoulder pads 22 and a plurality of handle members of pairs of hand gripping rods 24 and 26.

The platform portion 14 of the frame member is provided with a platform plate 28 for supporting the operator of the machine and is rigidly attached to the upright frame members 16 by a plurality of horizontal bars 30 and angle support members 32 which are structurally functional to provide rigidity of the entire frame 12.

The upper end of the upright frame member 16 is provided with a cavity 34 which serves as a hydraulic reservoir having a fluid fill port and associated cap 36. The lower end of the cavity 34 is also provided with a port 38 for a purpose that will be hereinafter set forth. The upright frame member 16 is further provided with a mounting block 40 which supports the exercise bar 18 by means of the pivot pin 20. The upright frame member 16 also comprises a second outwardly extending block member 42 having at least one upwardly extending mounting ear 44.

The exercise device further comprises an elongated hydraulic cylinder 46 having a piston 48 reciprocally disposed inside the cylinder to separate the cylinder into an upper chamber 50 and a lower chamber 52. An elongated piston rod 54 is attached to the upper surface of the piston 48 and extends through a port 56 in the upper end of the cylinder, the outer end of the piston rod 54 being pivotally attached to the exercise bar 18 by a horizontal pivot pin 58. The lower end of the cylinder 46 is attached to the mounting ears 44 of the frame block 42 by means of a horizontally disposed pivot pin 60. The pivotal mounting of the upper end of the piston rod 54 is spaced from the fulcrum pin 20 of the elongated exercise rod such that said fulcrum 20 is between the pivot pin 58 and the operator interface equipment consisting of the pads 22 and the handle members 24 and 26. It is noted at this point that the fulcrum pin 20, the pivot pin 58 and the pivot pin 60 are all parallel such that the movement of the elongated exercise arm 18 is within a vertical plane perpendicular to said pivot pins. Further, the distance between the fulcrum point 20 and the operator interface portion of the exercise bar is of considerable length whereby movement of the operator interface over relatively short distances will be in a substantially vertical direction.

The lower end of the hydraulic cylinder 46 is provided with a fluid port 62 which is connected by suitable hydraulic lines 64 and 66 to the fluid port 38 of the cavity or reservoir 34 in the frame member 16. Interposed between the lines 64 and 66 is a valve assembly 68. The valve assembly 68 has a first passageway 70 connecting the lines 64 and 66, said passageway 70 having an adjustable restriction orifice passageway 72 with an exterior adjustment knob 74 for effectively changing the size of the orifice passageway 72.

The valve 68 has a second parallel passageway 76, said passageway having a check valve 78 installed therein whereby fluid may freely flow through the passageway 76 and check valve 78 when flowing from the reservoir 34 into the fluid chamber 52 of the hydraulic cylinder 46. The check valve 78 will prevent fluid flowing from the hydraulic cylinder 46 toward the reservoir through the passageway 76 thereby requiring any fluid passage in that direction to be through the restriction orifice 72.

Also attached to the valve assembly 68 is a pressure gauge 80 having a sensor member 82 which is in communication with the hydraulic line 64. Stated another way, the sensor 82, since it is in communication with line 64 thereby senses pressure between the restriction orifice 72 and the hydraulic cylinder chamber 52.

It is noted at this point that the piston 48 provides a fluid seal between the hydraulic chambers 50 and 52. However, the chamber 50 is vented to atmosphere by a suitable vent 82 or simply by tolerances between the opening 56 and the piston rod 54. The pressure gauge 80 is provided with an arcuate calibration dial 84 which is calibrated in pounds or other units of force and relates the actual amount of force applied at the operator interface of the exercise bar 18 to the fluid back pressure provided between the hydraulic piston 48 and the restriction orifice 72.

In the case of the squat-jump type exercise hereinbefore described, the user places his shoulders against the operator interface pads 22, grips the handles 24 or 26 and pulls that end of the exercise bar 18 down to the squat position. He then can quickly try to straighten his legs which results in a resistance force due to back pressure of the hydraulic fluid passing through the orifice 72. The machine will allow the user to straighten to the full upright position against said force and then he may rapidly return to the squat position since fluid flow in the opposite direction encounters substantially no resistance through the check valve 78. This allows the operator to perform the repetitions of the squat jump exercise in rapid succession.

Further, if greater resistance is desired, the restriction orifice may be adjusted to provide such greater resistance. The more rapidly the user attempts to operate the machine the more force he encounters due to the nature of the fluid flow through the orifice. Hence, the machine may be used by many different athletes in a group, one after another, without any substantial adjustment to the machine and without the dangers accompanied by weight lifting due to the dropping of weights, changing of weights and possible muscle strain encountered by positioning the weights for the particular exercise.

Whereas the present invention has been described with particular relation to the drawings attached hereto, it is pointed out that other and further modifications apart from those shown or suggested herein may be made within the spirit and scope of the invention.

What is claimed is:

1. An exercise machine comprising:

(a) a frame;

(b) an exercise bar pivotally carried by the frame at a fulcrum point;

(c) means for operator actuation carried by one end of the exercise bar;

(d) an elongated hydraulic cylinder having cooperating piston and piston rod pivotally connected between the frame and the opposite end of the exercise bar, the means for operator actuation and the cylinder being on opposite sides of the fulcrum point;

(e) a separate fluid reservoir carried by the frame;

(f) line means for fluid communication between the reservoir and the cylinder on one side of the piston opposite the piston rod; and (g) a combination flow restriction and check valve provided in the fluid communication line wherein fluid flow is restricted in one direction and allowed to flow freely in the opposite direction whereby an applied force on the means for operator actuation in one direction causes a compression force on the piston rod.

2. An exercise machine as set forth in claim 1 wherein the separate fluid reservoir comprises a hollow cavity in the frame, a fluid port in the lower portion of the cavity in communication with the line means and a fill port in the upper portion thereof for the introduction of hydraulic fluid.

3. An exercise machine as set forth in claim 1 and including a fluid pressure gauge having a sensor in communication with the hydraulic cylinder on the fluid side of the piston.

4. An exercise machine as set forth in claim 3 wherein the pressure gauge is calibrated to reflect total units of force applied to the means for operator actuation.

5. An exercise machine as set forth in claim 1 wherein the piston rod is pivotally attached to the exercise bar and the cylinder is pivotally attached to a frame.

6. An exercise machine as set forth in claim 1 wherein the flow restriction portion of the valve is an adjustable orifice.

7. An exercise machine comprising a horizontal platform, a vertically extending upright frame member rigidly secured to the upper end of the upright frame member, means for operator actuation carried by one end of the exercise bar for providing an upward force thereat, an elongated hydraulic cylinder having cooperating piston and piston rod, said cylinder being pivotally connected to the upright frame member, the piston rod being pivotally connected to the opposite end of the exercise bar whereby an upward force applied to the means for operator actuation causes a compression force on the piston rod, a fluid reservoir carried inside the upright frame member, line means for providing fluid communication between the reservoir and the cylinder on one side of the piston opposite the piston rod, and a combination flow restriction and check valve provided in the fluid communication line whereby fluid flow is restricted in one direction and allowed to flow freely in the opposite direction.

* * * * *